United States Patent [19]

Sharp

[11] Patent Number: 5,054,645

[45] **Date of Patent: * Oct. 8, 1991**

[54] STORAGE TANK SYSTEMS WITH ENHANCED STRENGTH HAVING IN SITU FORMED INNER TANK

[76] Inventor: Bruce R. Sharp, 7685 Fields-Ertel Rd., Cincinnati, Ohio 45241

[ * ] Notice: The portion of the term of this patent subsequent to Oct. 3, 2006 has been disclaimed.

[21] Appl. No.: 518,076

[22] Filed: May 2, 1990

[51] Int. Cl.[5] ..... G01M 3/16

[52] U.S. Cl. ..... 220/445; 220/457; 220/466; 220/469; 73/49.2 T; 156/293

[58] Field of Search ..... 220/454, 455, 457, 445, 220/426, 466, 469; 73/49.2 T; 156/289, 293

[56] References Cited

U.S. PATENT DOCUMENTS

| | | | |
|---|---|---|---|
| 3,220,595 | 11/1965 | Edwards | 220/469 |
| 3,698,597 | 10/1972 | Burke | 220/426 |
| 4,561,292 | 12/1985 | Pugnale et al. | 220/441 |
| 4,651,893 | 3/1987 | Mooney | 220/457 |
| 4,653,312 | 3/1987 | Sharp | 73/49.2 T |
| 4,825,687 | 5/1989 | Sharp | 73/49.2 T |
| 4,840,283 | 6/1989 | Lillywhite et al. | 220/445 |
| 4,859,262 | 8/1989 | Sharp | 220/466 |
| 4,871,078 | 10/1989 | Sharp | 220/466 |
| 4,875,361 | 10/1989 | Sharp | 73/49.2 T |
| 4,913,310 | 4/1990 | Sharp | 73/49.2 T |

FOREIGN PATENT DOCUMENTS

| | | | |
|---|---|---|---|
| 470984 | 5/1969 | Switzerland | 220/454 |

*Primary Examiner*—Stephen Marcus
*Assistant Examiner*—S. Castellano
*Attorney, Agent, or Firm*—Charles R. Wilson

[57] ABSTRACT

A double walled storage tank system comprises an outer tank shell, a separating material and an inner tank made of a fibrous reinforced resinous material. The separating material has a series of holes extending therethrough to act as molds to receive resinous material. An inner tank is formed in situ. The tank system has an integral structural strength capable of withstanding external load forces normally encountered by underground storage tanks. Secondary containment with leak detection capability is provided.

11 Claims, 2 Drawing Sheets

STORAGE TANK SYSTEMS WITH ENHANCED STRENGTH HAVING IN SITU FORMED INNER TANK

This invention relates to a method of making storage tank systems and the resultant tank systems. More particularly, the invention relates to underground storage tank systems which have a formed inner tank for a primary containment means.

BACKGROUND OF THE INVENTION

Storage tanks are widely used for the bulk storing of a great variety of liquids. Some of these liquids are highly corrosive and/or are flammable. There is a recognized need for such tanks to have a secondary containment means which is capable of containing leaked liquid from the storage tank. Rigid double walled tanks made of metal have been suggested as one alternative. While effective for containment purposes, such tanks, as presently available, are costly to build and difficult to install because of their weight. The tanks are built by basically forming two rigid tanks with different diameters and then placing one tank inside the other.

Double walled tanks made from fiberglass reinforced resinous material are also known. They are built using a number of distinct time consuming steps. In all known commercial methods, a cylindrical-shaped, reusable mold is used to build tank halves which are subsequently assembled to form a single wall tank. Next, a larger diameter reusable mold is used to build a horizontal half-tank. The fiberglass/resin is applied in a known manner to the mold and cured to form the half-tank. A second horizontal half-tank is formed. Next, the completed inner tank is placed into the larger diameter half-tank. The second larger diameter half-tank is placed over the inner tank, joined and sealed at the seams with its matching half-tank. The resultant product is a double walled storage tank system comprised of essentially two rigid tanks, one inside the other.

In recent years there have been suggested improved methods of building double walled storage tanks. U.S. Pat. Nos. 4,561,292, 4,640,439, 4,644,627, 4,744,137, 4,780,946 and 4,780,947 disclose double walled storage tank systems wherein means are used to maintain a spaced relationship between the walls of the tanks. The spaced relationship is needed for effective leak detection purposes. However, the spacing means suggested require a separate time consuming step in properly positioning some specially constructed material on an inner tank wall prior to forming an outer tank wall. U.S. Pat. Nos. 4,859,262 and 4,871,078 disclose double walled storage tank systems which also use special materials, though the systems are more efficiently built.

There has now been discovered methods whereby new and used storage tanks can be provided with secondary containment means in a convenient, yet economical manner. Further, used storage tanks are refurbished to a standard equivalent to that possessed by a new tank and then upgraded to have a secondary containment feature.

SUMMARY OF THE INVENTION

A method of forming a double walled storage tank system comprises the steps of (a) applying a separating material on the interior surface of a rigid outer tank shell, (b) applying a layer of a fibrous reinforcing material onto the separating material, and (c) applying a resinous material onto or with the reinforcing material to form an inner tank. A series of spaced holes are provided in the separating material to act as molds to receive resinous material during the inner tank formation. When the resinous material is cured, a tank is formed which provides primary containment for stored liquid. The outer tank shell provides secondary containment for any liquid which may leak from the inner tank. The resinous attachment columns are formed for enhanced storage tank system strength. The space between the rigid outer tank shell and formed inner tank is a continuous space which can be monitored for any leakage.

DETAILED DESCRIPTION OF THE INVENTION

While the description to follow describes the invention in terms of its use with underground storage tanks, it should be understood the invention has applicability for other uses as well. However, the invention lends itself particularly well to underground storage tanks used for storing liquid gasoline and, therefore, this preferred use 1 is described in the following paragraphs.

Storage tanks are well known and are widely used, especially in the gasoline service station industry. They are typically made of metal or, more recently, a fibrous reinforced resinous material. Either type of tank has use in this invention. Normally, the wall of a metal tank is from about 0.125 inches to about 0.75 inches thick, while the wall of a fibrous reinforced resinous material tank with ribs is from about 0.125 inches to about 0.40 inches thick. The wall thickness is dependent on the tank's size and, of course, must be able to withstand external load forces when buried underground.

Figure 1:
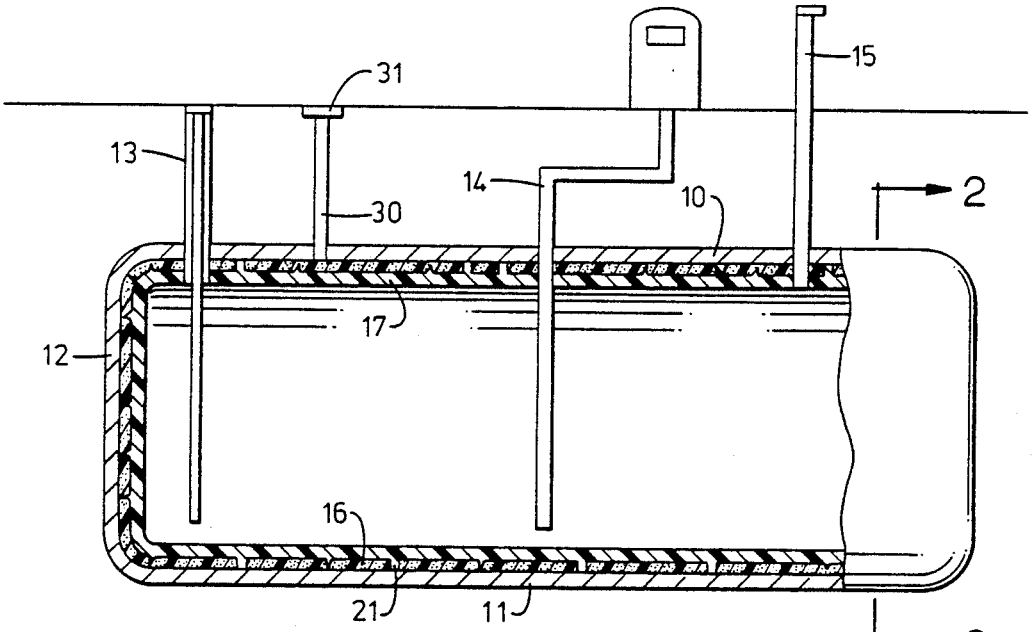
FIG. 1 is a side view in partial section of a double walled storage tank system having an in situ formed inner tank.
Figure 2:
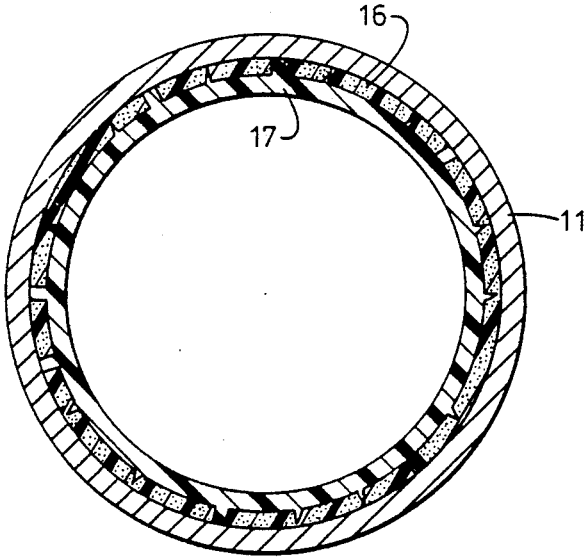
FIG. 2 is an end view of the double walled storage tank system of FIG. 1 taken along line 2—2.

A typical metal underground storage tank 10 which serves as a part of the storage tank system of this invention is shown in FIG. 1. The tank is cylindrical-shaped with side walls 11 and end caps 12. Sufficient openings are found in the storage tank 10 to allow for various access lines to communicate with the interior of the tank. A fill pipe 13, a dispensing line 14 and a vent pipe 15 are conventional in nature and serve their known functions.

In accord with this invention, a separating material 16 is positioned completely over the interior of the side walls and end caps of the rigid outer tank shell. Next, an inner tank 17 is formed over the separating material. The separating material and inner tank and their modes of application are described in detail in the following paragraphs.

The separating material used in this invention is in the form of a continuous thin sheet. It can as well be in the form of several strips of sheet material which are abutted side by side on the tank wall to cover it. One purpose of the separating material is to ensure that a subsequently applied fibrous reinforcing material and resinous material which form the inner tank will not adhere to the tank shell. It is necessary that the annular space between the outer tank shell and inner tank have a continuous area between the two. Such annular space is closed and provides true secondary containment capability. Additionally, any sudden stress in the outer tank shell or inner tank which may cause a crack therein is less likely to be transmitted to the other.

Examples of separating materials which are available in sheet form and used in this invention are open-cell synthetic foams, jute, matting, meshes, screens and cardboard. Preferably, they are gas pervious in nature. The sheets are thin. They range from about one-eighth inches to about one inch in thickness, preferably about one-eighth inch to about one-fourth inch in thickness. The gas pervious nature of the separating material allows migration of leaked liquid and a consequent ready detection thereof. Thus, liquid which leaks from the inner storage tank in one location will be free to migrate and be detected in a remote location of the closed space. Special precautions must be taken to ensure that the gas pervious nature of the separating material is maintained. Prior to formation of the inner tank, the separating material may at least partly sealed to prevent excessive penetration of a resinous material. Without the sealing, the resinous material used in the formation of the inner tank will saturate the separating material to effectively fill or close the material. At least partially sealing the gas pervious separating material in a controlled manner prevents this complete saturation.

The preferred method of sealing the separating material involves spray applying a resinous material to its outside surface. The resinous material should readily harden. Examples of such resinous materials include polyesters, vinylesters, polyalkylenes, polyvinylchlorides, polyurethanes and polyepoxides. Preferably, the same resinous material used in forming the inner tank is also used for partial sealing purposes. Heat sealing the outside surface of the separating material also effectively prevents excessive resin penetration during the inner tank formation step. Any degree of sealing provides a benefit in slowing penetration of resinous material from the subsequent inner tank formation from occurring. A cost savings is also achieved from use of less resinous material, but most importantly the gas pervious nature of the material is maintained.

Figure 3:
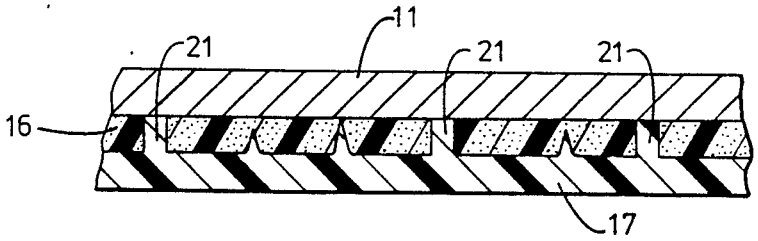
FIG. 3 is a partial side view in section of the double walled storage tank system of FIG. 1.
Figure 4:
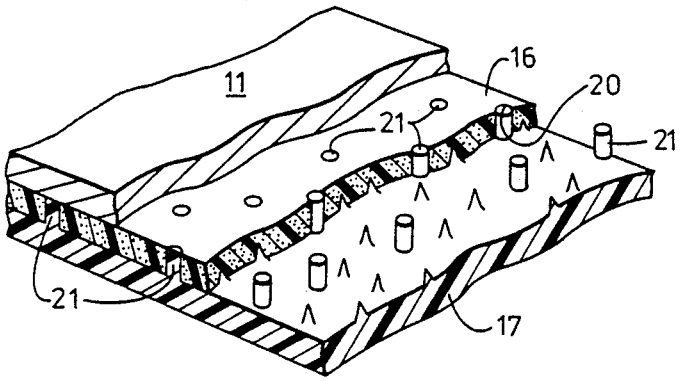
FIG. 4 is cut away partial view in perspective of a section of the double walled storage tank system of FIG. 1.

As best seen in FIGS. 3 and 4, the separating material has a series of holes extending through it. The holes 20 shown are uniformly spaced, though can as well be randomly spaced. The holes are spaced such that about 20 holes to about 350 holes per square foot of surface area is provided. Preferably, the holes are spaced to provide from about 20 holes to about 100 holes per square foot of surface area. The holes are any shape, though to be effective for this intended function, each hole should be at least about one-eighth inches in its minimum cross dimension and less than about three inches in its maximum cross dimension. For manufacturing reasons the holes are circular and have diameters ranging from about one-eighth inches to about three inches, preferably from about one-fourth inches to about one and one-half inches. The holes 20 act as molds to receive liquid resinous material during formation of the inner tank as explained below.

Inner tank 17 is a fibrous reinforced resinous material. In one method, it is formed by first applying a layer of fibrous reinforcing material on the separating material 16 found on the outer tank shell 10. The fibrous reinforcing material can take on many different physical shapes and structures variously referred to as mattings, nets, screens, meshes, threads, strands and chopped strands. Examples of fibrous materials include fiberglass, nylon, and other synthetic fibrous materials. The fibrous material, if in a sheet form, can be laid onto the tank shell as a continuous matting. Once the fibrous reinforcing material is applied, a resinous material is next applied to the reinforcing material and thereafter cured. Several different resinous materials are known for the purpose of reinforcing fibrous material. Such materials include polyesters, e.g. vinylesters, isophthalic polyesters, polyethylene, polypropylene, polyvinylchloride, polyurethane, and polyepoxide. The listed resinous materials used in the construction of this inner tank are not all inclusive, but only illustrative of some of the resinous materials which can be used.

Alternatively, the fibrous material is applied in the form of chopped strands with the resinous materials described in the previous paragraph. That is, the chopped strand and resinous material are 1 sprayed from separate nozzles of the same spray gun and the inner tank formed therefrom on the separating material as the resin cures. Other known methods of forming a fibrous reinforced resin substance can be used.

The shape of the resultant inner tank is such that it covers the interior side walls and end caps of the outer tank shell to form the closed annular space between the walls. The inner tank itself is capable of containing any liquid which is stored.

Resinous attachment columns 21 are formed in the holes 20 during the inner tank formation. The attachment columns are themselves small enough and spaced sufficiently apart that the leak detection capability of the gas pervious separating material is not impaired. At the same time, the attachment columns serve to maintain the independence of the outer tank shell and the inner tank. That is, the attachment columns resist a crushing or collapsing of the inner tank onto the rigid outer tank shell. This, of course, is necessary to retain the closed annular space between the two walls for the leak detection reasons.

The strength of the storage tank system has sufficient structural integrity to withstand external and internal load forces normally encountered by underground storage tanks without suffering significant cracking or collapsing. The strength of either outer tank shell or inner tank is not important; rather it is the system's integral structural strength which is important. The resinous attachment columns which are formed in the holes during inner tank formation are responsible for the enhanced structural strength of the storage tank system. The attachment columns tie the inner tank to the outer tank shell so that the tank shell and inner tank act as one as far as being able to withstand normal external and internal faces experienced by a storage tank system of the type herein. Each attachment column is small enough in its cross-dimension that any failure of the tank shell or inner tank in the area of the attachment columns will cause a shearing or breaking apart of the column itself and not impair the integrity of the inner tank. That is, the attachment column at the points it attaches to the outer tank shell and inner tank are weak points designed to fail first.

Figure 5:
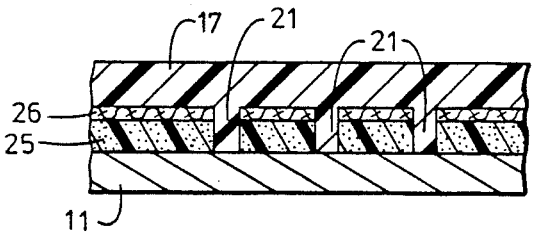
FIG. 5 is a partial side view of a section of a double walled storage tank system wherein a fabric-backed separating material is used.

In a preferred embodiment of the invention shown in FIG. 5, the separating material 25 is provided with a fibrous backing 26. It has been found that the liquid resinous materials used in sealing and inner tank formation tend to cause many of the separating materials to warp or distort. The fibrous backing helps the separating material to maintain its dimensional stability. Preferably, the fibrous backing is on the outside surface of the separating material, though can as well be the inside surface adjacent the outer tank shell. The fibrous backing must itself be pervious to liquid so as not to interfere with the migration and detection of leaked liquid. Examples of suitable fibrous backings include woven fabrics, nets, and screens made of natural and/or synthetic materials. The backing is preferably embedded in the material's surface during formation and is in effect an integral part of it.

The space between the outer tank shell 10 and the inner tank 17 can be monitored. As shown in FIG. 1, an access tube 30 extends from ground level through the outer tank shell so as to be in communication with the closed space. Any of well known and commercially available monitor means can be used. For example, the closed space can be filled with a detecting liquid. This detecting liquid can be placed in the closed space by the manufacturer of the tank. At the end of the access tube is a sight glass 31. Whenever leakage occurs, a change in the level or color of a detecting liquid will occur and will be readily observed in the sight glass. Instead of the sight glass and visual observation of a change in level or color of detecting liquid, non-visual leak detection means, including pressure transducers and float controls can be used to detect a change in level.

Alternatively, the closed space can be placed either under a non-atmospheric pressure, i.e. a positive or negative air pressure. Detection means associated with the closed space is capable of detecting any change in pressure resulting from the leak in the tank shell or the inner tank. A conventional air pump or vacuum pump, together with an associated pressure regulator can be used. A pressure change sensor is a part of the detection means. A pressure gauge serves this purpose adequately. Optionally, an alarm system can be electronically linked with the pressure sensor to audibly or visually warn of a pre-set significant pressure change. The gas pervious material maintains a spaced relationship between the outer tank shell and inner tank when a vacuum is used as well as serves as the separating agent.

Another embodiment of the detection means utilizes an analyzer capable of detecting the liquid being stored. Thus, the detection means comprises the analyzer which is in communication with the closed space. Preferably, a vacuum means for withdrawing gaseous material from the closed space is used for the purpose of obtaining a sample. Still another detection means utilizes a probe which extends through an access tube so as to monitor for leakage, preferably at or near the bottom of the closed space. The probe is capable of detecting pre-selected liquids or gases.

The invention herein has been described with particular reference to the drawings. It should be understood other variations of the invention are within the scope of coverage.

What is claimed is:

1. A storage tank system for liquids having secondary containment capability and sufficient integral structural strength to withstand external load forces normally encountered by underground storage tanks, comprising:

(a) a rigid outer tank shell;

(b) a separating material positioned around an interior surface of the outer tank shell, said separating material characterized in having a series of holes extending therethrough rough with each hole at least about one-eighth inches in its minimum cross-dimension and less than about three inches in its maximum cross-dimension and further wherein said holes are filled with a resinous material to form attachment columns; and (c) an inner tank made of a fibrous reinforced resinous material which is completely encased by the outer tank shell to form a closed space therebetween, said inner tank being partially structurally independent from the outer tank shell because of the separating material, and structurally connected by the resinous material attachment columns to the outer tank shell so that said inner tank and outer tank shell reinforce one another to achieve enhanced structural strength.

2. The storage tank system of claim 1 wherein the outer tank shell is a metal tank.

3. The storage tank system of claim 1 wherein the outer tank shell is made of a fibrous reinforced resinous material.

4. The storage tank system of claim 1 wherein fiberglass is used to reinforce the resinous material.

5. The storage tank system of claim 1 wherein the separating material is a gas pervious separating material.

6. The storage tank system of claim 5 wherein the gas pervious separating material ranges from about one-eighth inches to about one inch in thickness.

7. The storage tank system of claim 6 wherein the gas pervious separating material ranges from about one-eighth inches to about one-fourth inches in thickness.

8. The storage tank system of claim 1 wherein the holes are circular and have diameters ranging from about one-eighth inches to about three inches.

9. The storage tank system of claim 8 wherein the holes have diameters ranging from about one-fourth inches to about one and one-half inches.

10. The storage tank system of claim 1 wherein the holes are substantially uniformly spaced to provide from about 20 to about 350 attachment columns per square foot of surface area.

11. The storage tank system of claim 10 having from about 20 to about 100 attachment columns per square foot of surface area.

* * * * *